United States Patent [19]

Schellstede et al.

[11] Patent Number: 4,932,129

[45] Date of Patent: Jun. 12, 1990

[54] CASING PUNCH FOR WELLS

[75] Inventors: Herman J. Schellstede, New Iberia, La.; Robert W. McQueen, Houston; Alan D. Peters, Katy, both of Tex.

[73] Assignee: Penetrators, Inc., Houston, Tex.

[21] Appl. No.: 279,649

[22] Filed: Dec. 5, 1988

[51] Int. Cl.[5] ..... B26F 1/00

[52] U.S. Cl. ..... 30/358; 83/691; 166/55; 166/55.2; 175/402; 175/414

[58] Field of Search ..... 30/358, 366, 368, 315, 30/359, 360; 75/325; 83/30, 188, 684, 686, 690, 691, 697; 175/286, 267, 389, 402, 414; 166/55, 55.1, 5.2, 55.3, 298

[56] References Cited

U.S. PATENT DOCUMENTS 3,320,843 5/1967 Schott, Jr. ..... 83/691

*Primary Examiner*—Frederick R. Schmidt
*Assistant Examiner*—M. Rachuba
*Attorney, Agent, or Firm*—Mason, Fenwick & Lawrence

[57] ABSTRACT

A metal punch is formed of a cylindrical body member having an outer cylindrical surface and a forward workpiece engaging end; an axial bore extends rearwardly from the forward end with the workpiece engaging portion of the being defined from front to rear by planar surfaces in first and second perpendicular planes, first and second transverse cylindrical surfaces and first and second annular arcuate surfaces. The planes intersect along a line passing through the axis, to define cutting edges. The transverse cylindrical surfaces are symmetrical to each other with respect to the axis as are the annular arcuate surfaces.

14 Claims, 2 Drawing Sheets

CASING PUNCH FOR WELLS

BACKGROUND OF THE INVENTION

The present invention is in the field of punching means for providing openings in metal objects and the like and is more particularly directed to a new and unique punch member for use in punching holes in oil and gas well casings for effecting a penetration operation into a surrounding producing geological formation.

Prior U.S. Pat. Nos. 4,640,362 and 4,765,173 to Herman J. Schellstede disclose a punch member 264 having a cylindrical body, and axial bore 353 and channel grooves 354 provided on each side of the punch member. The punch member includes the removable outer tip 264 defined by intersecting planar surfaces 256, 258 to intercept along a line 260. The punch is mounted on element 262 by threaded connection means which can shear in the event of substantial lateral force being applied to the tip member.

While the punch construction of the aforementioned Schellstede patents represented a substantial advance over the art in that it permitted the opening of "doors" on each side of the opening formed in the casing by folding back a portion of the casing in which the opening is provided, such punches do not always provide satisfactory operation. More, specifically the casing would be punched with the "doors" remaining attached to the casing upon completion of the punching operation. However, in some instances the "doors" would not open sufficiently to assure adequate clearance for a high pressure injector lance to move outwardly axially through the axial bore in the punch past the doors into the surrounding formation. The problem of the "doors" not opening adequately was particularly critical when the punching operation was being performed in a casing surrounded by cement. Thus, the problem of always providing a sufficiently wide punch opening for effective deployment of the lance has not been fully solved and the present invention is directed toward the solution of such problem.

SUMMARY OF THE INVENTION

The present invention is directed to a punch construction of generally cylindrical body shape having an axial opening extending along its length. The inventive punch provides for a wider opening in a casing or other metal member being punched by the punch member by employing a unique contour on the forward surface of the punch member which results in the provision of an opening in the casing of greater size than was previously possible using the same size punch members.

The punch comprises a generally cylindrical body member having a forward end comprising a cutting tip engagable with a casing to be cut and a rear end adapted to be mounted on support means for moving the punch along its longitudinal axis. More specifically, the cutting tip of the punch member is formed with first and second perpendicular planar surfaces which intersect on a transverse line extending substantially perpendicularly with respect to the longitudinal axis of the punch member. The rear portion of each planar surface is smoothly merged with a forward portion of a respective transverse cylindrical surface having a center of curvature positioned outwardly of the punch member and forwardly of the cutting edge defined by the planar surfaces. Each transverse cylindrical surface is provided rearwardly of one of the planar surfaces with the transverse cylindrical surfaces being symmetrically positioned with respect to a plane defined by the line of intersection of the planar surfaces and the longitudinal axis of the punch. The rear portion of each transverse cylindrical surface merges with the forward extent of an annular arcuate surface of the main body which has its center of curvature along an arc positioned inwardly of the outer cylindrical surface defining the periphery of the body portion of the punch member.

Additionally, the punch member includes a rearwardly facing threaded socket coaxially positioned adjacent its rear extent and into which a threaded all-thread tubular fitting is received with the all-thread tubular fitting extending rearwardly from the cylindrical body portion of the punch member. The tubular fitting is dimensioned and constructed so as to be threadably mounted on a moveable cam follower base 258, 262 as shown in U.S. Pat. No. 4,640,362. More specifically the all-thread tubular fitting is threadably received in a threaded stubb 262 with the entire assembly being moved outwardly radially with respect to a casing member in which the device is positioned. Movement of the punch through a casing wall punches out a plug from the casing to provide an opening therein through which a moveable nozzle jet on the end of a lance member mounted for movement in the axial opening extending the length of the punch can be moved to extend outwardly into the formation.

DESCRIPTION OF THE PREFERRED EMBODIMENT

Figure 1:
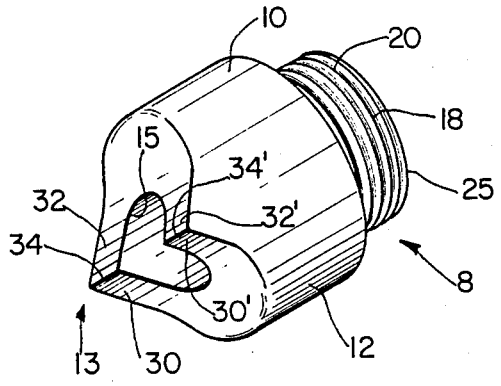
FIG. 1 is a perspective view of the preferred embodiment of the invention showing the preferred embodiment lying on its side with its forward or cutting end facing the viewer.

The preferred embodiment of the invention, generally designated 8, comprises a unitary cylindrical body member 10 and an all-thread tubular connector fixture 18. Body member 10 has an outer cylindrical surface 12, a forward end 13, a rearward end 14 and a forward axial bore 15. A large diameter threaded axial opening 17 is provided rearwardly of bore 15.

An all-thread tubular connector fixture 18 is provided with outer threads 20 threadably received in threaded axial opening 17, a central bore 22 extending rearwardly from its forward end 23 and a flared bore 24 adjacent its rear end 25. It will be noted that the threads 20 are discontinued in a central groove 26 of the all-thread connector fixture 18 to provide a weakened construction which serves as a shear line in the event of the application of excessive forces to the generally cylindrical body member 10.

The rearward end 13 of the generally cylindrical body member 10 comprises a planar surface 14 oriented in a transverse plane perpendicular to the longitudinal axis "A" of the punch body member 10. It should also be noted that the all-thread connector fixture 18 is coaxial with respect to the longitudinal axis "A".

The forward end 13 of the cylindrical body member 10 is of complex shape and comprises first and second planar surfaces 30, 30' and 32, 32'. Surfaces 30 and 30' are separated by bore 20 but are coplanar in a plane perpendicular to a plane in which surfaces 32, 32' are located. Surfaces 32, 32' are similarly separated by bore 20. The intersection of planar surfaces 30 and 32 and planar surfaces 30' and 32' are on a common line passing perpendicularly through axis A and define aligned cutting edges 34 and 34' on opposite sides of forward axial bore 15.

Figure 2:
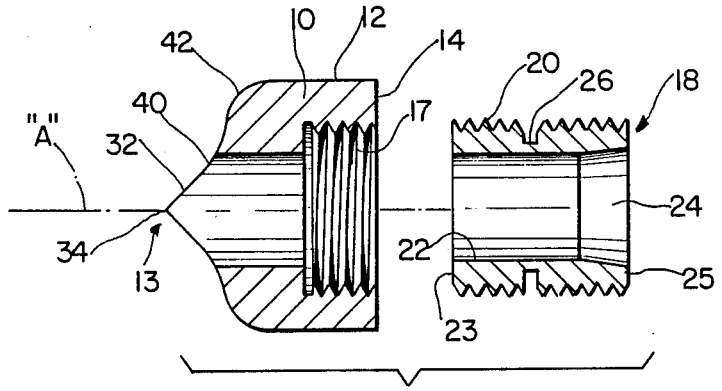
FIG. 2 is a bisecting sectional view of the preferred embodiment.
Figure 4:
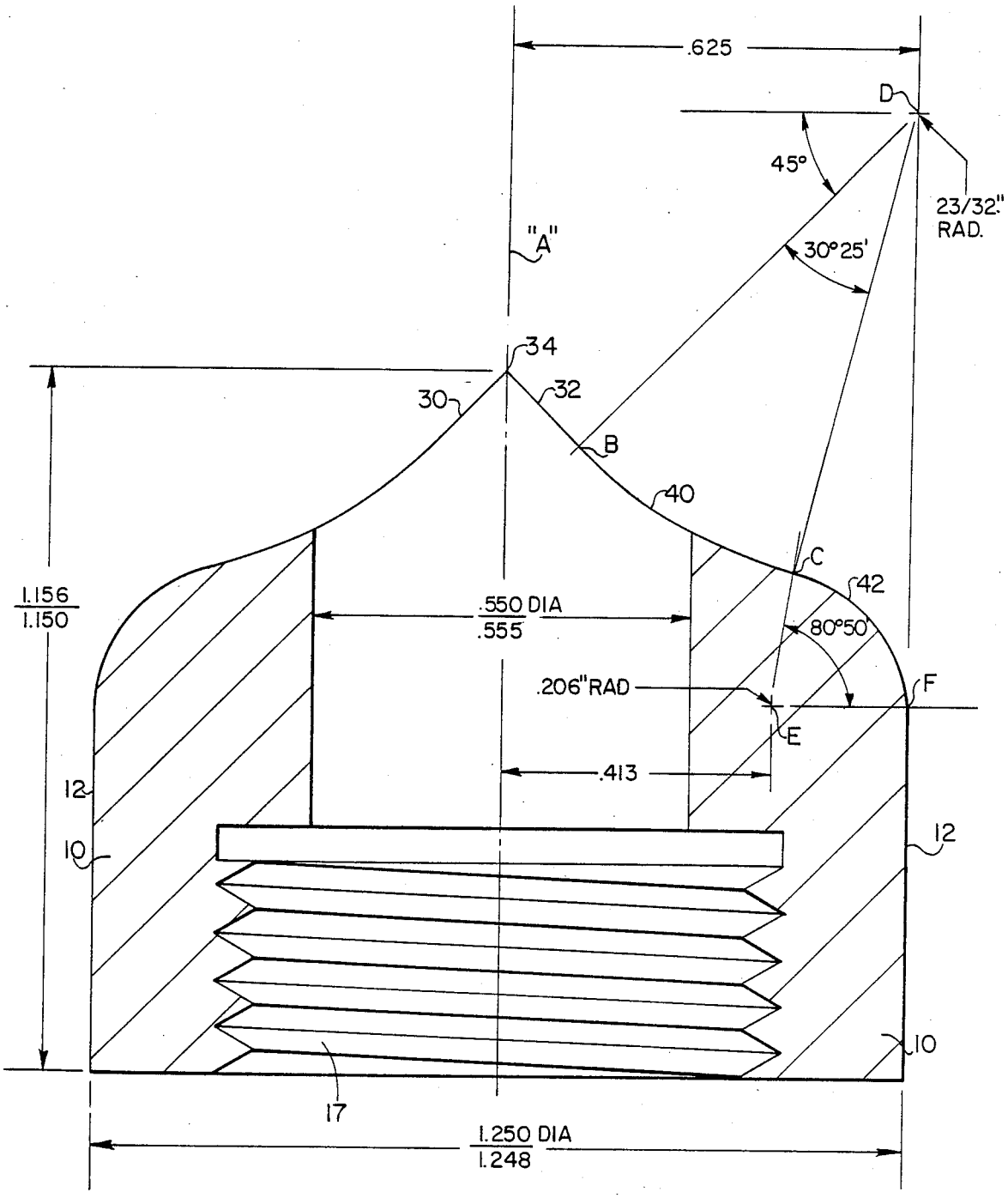
FIG. 4 is an enlargement of a portion of the sectional view of FIG. 2 illustrating the geometric relationship and dimensions of the planar and other surfaces and parts of the preferred embodiment of the punch member.

The planar surface 32 terminates rearwardly at a line B (FIG. 4) parallel to cutting edges 34 and 34' and smoothly merges into a transverse cylindrical surface 40 which has a center of curvature on a line D positioned externally of the cylindrical body member 10, tangential to an upward extension of cylindrical surface 12 and extending parallel to cutting edge 34 as shown in FIG. 4. Transverse cylindrical surface 40 has an arcuate extent from line B to line C which respectively define its forward and rearward edges with the side edges of transverse cylindrical surface 40 being defined by its intersections on its opposite end with cylindrical surface 12. Transverse cylindrical surface 40 smoothly merges with an annular arcuate surface 42 which has a center of curvature E internally of the cylindrical body member 10 and which lies on an arc concentric to axis A. The rear edge of annular arcuate surface 42 merges with cylindrical surface 12 along an arc F. Thus, the cross-sectional edge of the punch member as shown in FIG. 2 and FIG. 4 consists of an outer straight edge 34 followed from front to rear by a straight planar portion 32 and an undulating "S-shaped" curve which merges into cylindrical surface 12. The opposite side of the punch is obviously a mirror image of the surfaces 32, 40 and 42 and comprises corresponding surfaces 30, 40' and 42'. All parts of the punch body 10 are formed of H-13 tool steel (Carpenter 883) which is heat treated all the way through to a hardness of 44 Rc.

Figure 3:
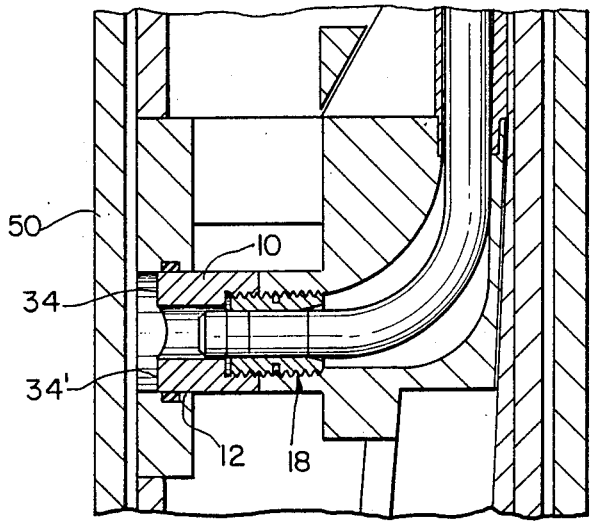
FIG. 3 is a sectional view illustrating the manner of mounting of the preferred embodiment in a device of the type shown in U.S. Pat. No. 4,640,362.

FIG. 3 illustrates the manner in which the device is positioned in the well penetration device of the aforementioned Schellstede patents. It has been found that use of the preferred embodiment of the device provides a substantially larger opening by the removal of a one piece slug of material from the casing 50 to provide a larger opening than was previously possible to permit the forward end of lance member to pass through the opening and move outwardly beyond the casing into the surrounding formation.

While only preferred embodiment has been disclosed, it should be understood that the spirit and scope of the invention is not limited to the preferred embodiment is limited solely by the appended claims.

We claim:

1. A metal punch comprising a generally cylindrical body member having an outer cylindrical surface and a longitudinal axis about which said outer, cylindrical surface is concentric, a forward workpiece engaging end, a rear end attachable to drive means for moving said punch forwardly along said axis to effect a punching operation in a workpiece, an axial bore extending rearwardly from said forward end, said forward workpiece engaging end being defined from front to rear by planar surfaces in first and second plane, first and second transverse cylindrical surfaces and first and second annular arcuate surfaces, said planes being oriented substantially perpendicular to each other and intersecting along a line passing through said axis, said transverse cylindrical surfaces being symmetrical reactive to each other with respect to said axis and each having a front portion smoothly merging with one of said planar surfaces and a rear portion smoothly merging with a front portion of one of said annular arcuate surfaces and side edges merging with said outer cylindrical surface and having a center of curvature positioned externally of said body member and wherein said annular arcuate surfaces have a center of curvature positioned internally of said body member.

2. A punch as recited in claim 1 wherein said annular arcuate surfaces are symmetrical relative to each other with respect to said axis.

3. A punch as recited in claim 2 wherein said transverse cylindrical surfaces have centers of curvature along lines positioned in a plane oriented perpendicular to said axis and positioned externally of said punch.

4. A punch as recited in claim 3 wherein said centers of curvature of said transverse cylindrical surfaces are positioned in tangential manner with respect to an extension of said outer cylindrical surface.

5. A punch as recited in claim 4 wherein said transverse cylindrical surfaces have an arcuate extent of approximately 30° 25' about their centers of curvature.

6. A punch as recited in claim 5 wherein said annular arcuate surfaces have an arcuate extent in cross-section of approximately 80° 50' about their center of curvature.

7. A punch as recited in claim 1 additionally including an axially concentric threaded socket surface extending forwardly from the rear end of said body member and an all-thread tubular fitting threaded into said concentric threaded surface.

8. A punch as recited in claim 7 wherein said all-thread tubular fitting includes a circumferential groove centrally of its length for defining a shear area.

9. A punch as recited in claim 1 wherein said planar surfaces comprise first and second surfaces in said first plane positioned on opposite sides of said axial bore and third and fourth planar surfaces in said second plane positioned on opposite sides of said axial bore and wherein a central portion of the upper extent of the transverse cylindrical surfaces is defined by an intersection of said transverse cylindrical surfaces with said axial bore.

10. A punch as recited in claim 9 wherein said annular arcuate surfaces are symmetrical relative to each other with respect to said axis.

11. A punch as recited in claim 10 wherein said transverse cylindrical surfaces have centers of curvature positioned in a plane oriented perpendicular to said axis and positioned externally of said punch.

12. A punch as recited in claim 11 wherein said centers of curvature of said transverse cylindrical surfaces are lines positioned in tangential alignment with extensions of said outer cylindrical surface.

13. A punch as recited in claim 12 wherein said transverse cylindrical surfaces have an arcuate extent of approximately 30° 25' about their centers of curvature.

14. A punch as recited in claim 13 wherein said annular arcuate surfaces have an arcuate extent in cross-section of approximately 80° 50' about their center of curvature.

* * * * *